US006895854B1

(12) United States Patent
Plattner

(10) Patent No.: US 6,895,854 B1
(45) Date of Patent: May 24, 2005

(54) POWER CYLINDER APPARATUS FOR SUPPLYING VARYING ACTUATION FORCES

(76) Inventor: Wesley M. Plattner, 1146 Breyman Hwy., Tipton, MI (US) 48287

( * ) Notice: Subject to any disclaimer, the term of this patent is extended or adjusted under 35 U.S.C. 154(b) by 0 days.

(21) Appl. No.: 10/429,353

(22) Filed: May 5, 2003

(51) Int. Cl.[7] ..... F01B 7/20
(52) U.S. Cl. ..... 92/52; 92/62
(58) Field of Search ..... 92/52, 51; 91/169, 91/35

(56) References Cited

U.S. PATENT DOCUMENTS

| | | | | |
|---|---|---|---|---|
| 787,479 A | | 4/1905 | Tanner | |
| 2,764,131 A | | 9/1956 | Knights | |
| 3,269,275 A | * | 8/1966 | Waite | 92/52 |
| 3,499,369 A | | 3/1970 | Joseph | |
| 4,011,724 A | | 3/1977 | Landes et al. | |
| 4,205,594 A | | 6/1980 | Burke | |
| 4,561,248 A | | 12/1985 | Quin et al. | |
| 5,009,068 A | | 4/1991 | Clarke | |
| 5,165,322 A | | 11/1992 | Moody | |

* cited by examiner

*Primary Examiner*—F. Daniel Lopez
*Assistant Examiner*—Michael Leslie
(74) *Attorney, Agent, or Firm*—Young & Basile, P.C.

(57) ABSTRACT

The present invention relates to a power cylinder apparatus for varying actuation forces applied to a workpiece. The present invention provides an enclosure having a piston rod connectable to a workpiece and slidably disposed within an enclosure. The piston rod moves between a retracted position, wherein the piston rod is retracted within the enclosure, and an extended position, wherein the piston rod extends outwardly from the enclosure. A piston is slidably disposed on the piston rod for movement between the retracted position and the extended position. A bushing is provided within the enclosure for slidably supporting the piston rod and positively stopping the piston in the extended position. The piston rod and piston have varying surface areas substantially perpendicular to the direction of movement such that varying actuation forces may be provided to the workpiece through a supply of a constant fluid pressure.

15 Claims, 2 Drawing Sheets

POWER CYLINDER APPARATUS FOR SUPPLYING VARYING ACTUATION FORCES

FIELD OF THE INVENTION

The present invention relates to a power cylinder apparatus, and more particularly, a power cylinder apparatus for supplying varying actuation forces to a workpiece through the supply of a constant fluid pressure.

BACKGROUND OF THE INVENTION

Power cylinders are well known in the prior art. Such power cylinders typically provide an enclosure having a piston and piston rod slidably disposed within the enclosure, wherein the piston rod extends outwardly from the cylinder. Pneumatic or hydraulic passageways are provided at each end of the cylinder, whereby pressurized fluid is supplied or exhausted on either side of the piston, thereby forcing the piston and piston rod to move from one end of the cylinder to the other. The piston and the piston rod move simultaneously to provide linear actuator movement to a workpiece. Through such movement, an actuation force is imparted on the workpiece as the piston rod moves between an extended position, wherein the piston rod extends outward from the cylinder, and a retracted position, wherein the piston is withdrawn within the cylinder.

The actuation forces applied to the workpiece are governed by the formula, F=PS, where F is the force, P is the pressure within the cylinder, and S is the surface area of the piston and/or piston rod perpendicular to the force component. When the piston rod moves from the retracted position to the extended position, the surface area S equals the sum of the surface area of the piston and the end of the piston rod perpendicular to the force component. However, when the piston rod moves from the extended position to the retracted position, the surface area S equals only the surface area of the piston since the piston rod extends outside the cylinder and does not provide a surface area perpendicular to the force component or direction of movement. Therefore, the actuation forces generated in moving the workpiece from the retracted position to the extended position are typically greater than those generated when moving the workpiece from the extended position to the contracted position. The difference in the actuation forces is due to the difference in the surface areas of the piston and piston rod when moving between the extended and retracted positions.

It is sometimes desirable, however, to have different or similar actuation forces applied to the workpiece as the piston rod moves between the first position and the second position. For instance, it may be desirable to have the actuation forces greater or the same when moving toward the retracted position as opposed to the extended position. Previous designs have attempted to vary the actuation forces applied to the workpiece by manipulating the pressure levels within the power cylinder. These designs typically involve complex hydraulic and pneumatic controls and valves that are expensive to manufacture and difficult to maintain.

It would be desirable to provide a simple power cylinder that provides varying actuation forces to a workpiece. It would also be desirable to provide such a power cylinder that is inexpensive to manufacture and easy to maintain.

SUMMARY OF THE INVENTION

The present invention relates to a power cylinder apparatus for varying actuation forces to a workpiece. The present invention provides an enclosure having a piston rod connectable to the workpiece and slidably disposed within the enclosure. The piston rod moves between a retracted position, wherein the piston rod is fully retracted within the enclosure, and an extended position, wherein the piston rod extends outwardly from the enclosure. A piston is slidably disposed on the piston rod for movement between the retracted position and the extended position. A bushing is disposed in said enclosure for slidably supporting said piston rod and positively stopping said piston. The piston rod and piston have different surface areas substantially perpendicular to the direction of movement such that varying actuation forces may be provided to the workpiece through a supply of constant fluid pressure. Specifically, the actuation force supplied to a workpiece may be smaller or the same when the piston rod moves toward the extended position than when the piston rod moves toward the retracted position.

BRIEF DESCRIPTION OF THE DRAWINGS

The description herein makes reference to the accompanying drawings wherein like reference numerals refer to like parts throughout several views and wherein.

DESCRIPTION OF THE PREFERRED EMBODIMENT

Figure 1:
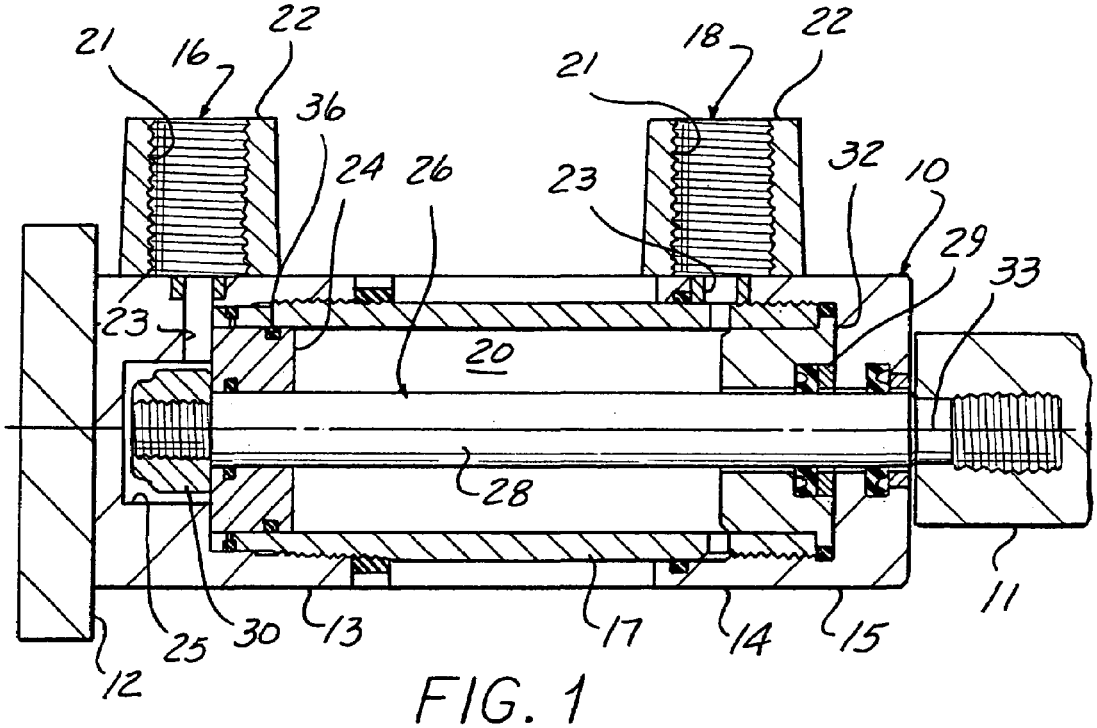
FIG. 1 is a sectional view of the power cylinder apparatus of the present invention showing the piston and piston rod in the retracted position.

Referring to the drawings, the present invention will now be described in detail with reference to the disclosed embodiment.

Figure 2:
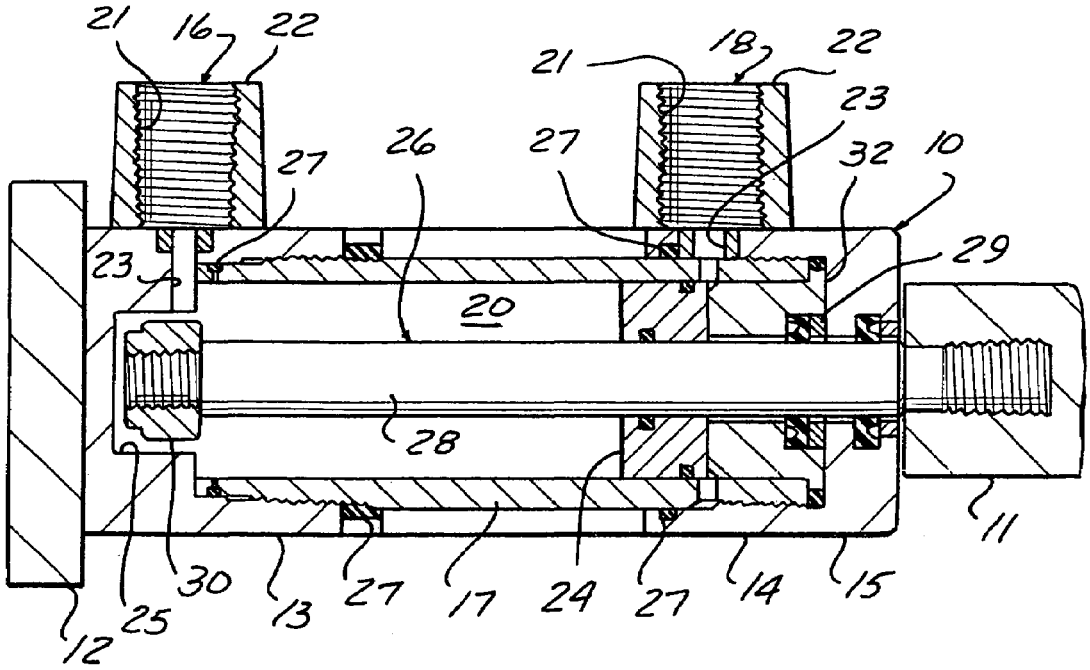
FIG. 2 is a sectional view of the power cylinder apparatus of the present invention showing the piston in the extended position and the piston rod in the retracted position.
Figure 3:
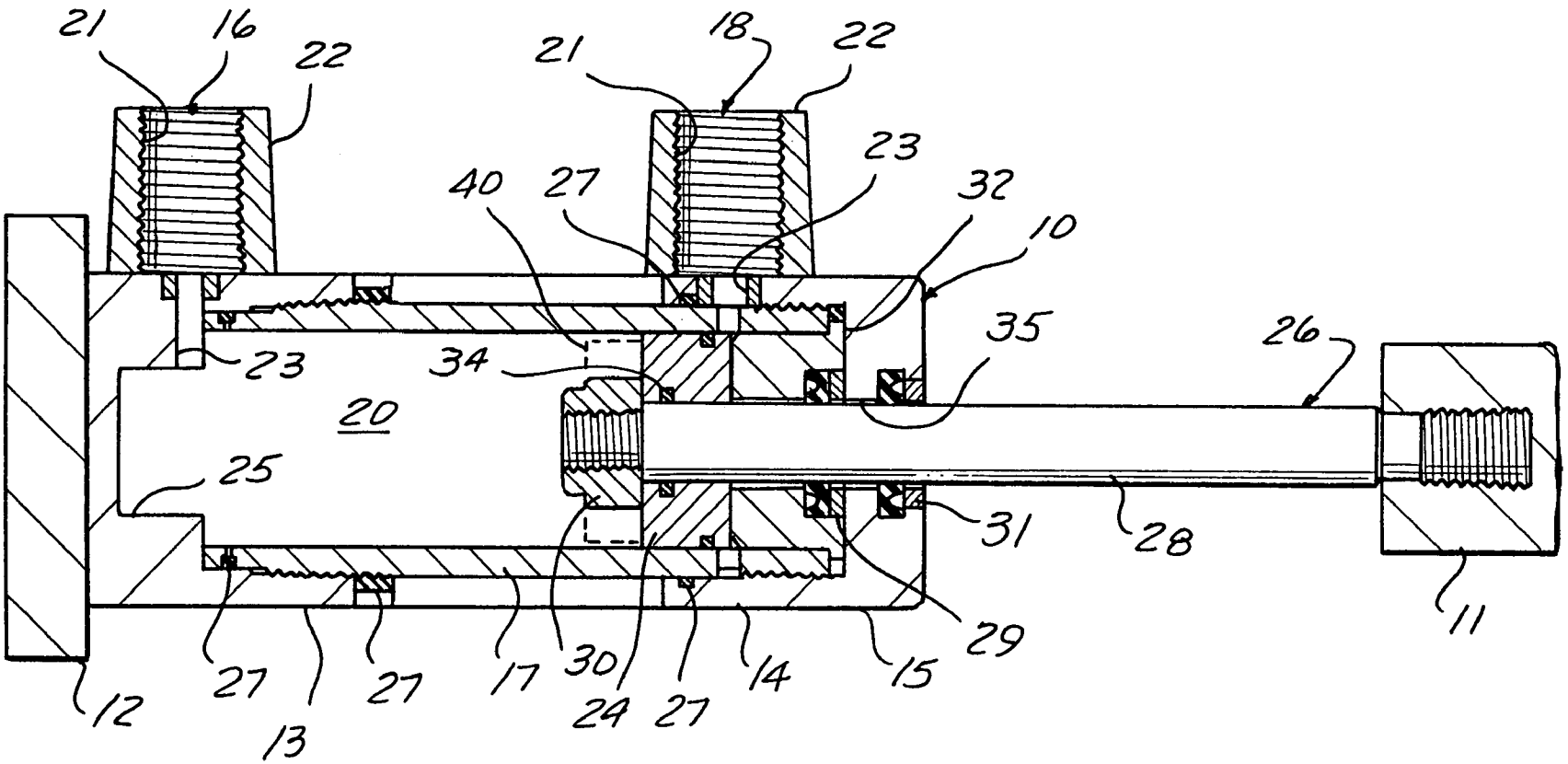
FIG. 3 is a sectional view of the power cylinder apparatus of the present invention showing the piston and the piston rod in the extended position.

FIGS. 1–3 illustrate a power cylinder apparatus 10 for providing varying actuation forces to a workpiece 11. The power cylinder 10 includes an enclosure 14 having a first and second passageway 16, 18, respectively, for communicating a pressurized fluid medium between a pressurized fluid source (not shown) and a bore 20 within the enclosure 14. Although the power cylinder apparatus 10 of the present invention is ideally suited for pneumatic applications, other fluid mediums are also anticipated, including, but not limited to, hydraulics. A piston rod 26 is slidably disposed within the enclosure 14 for movement between a retracted position, wherein the piston rod 26 is retracted within the enclosure 14, and an extended position, wherein the piston rod 26 extends outwardly from the enclosure 14. The piston rod 26 is connected to the workpiece 11 in order to move the workpiece 11 between the retracted and extended positions. The power cylinder apparatus 10 may be mounted on a base 12, and the power cylinder 10 and base 12 may be-mounted in any geometric orientation.

The enclosure 14 of the power cylinder apparatus 10 includes two end caps 13, 15 threaded onto an internal cylinder 17. Although this structure is best suited for the present invention, it is to be appreciated that the enclosure 14 may be constructed in any manner that provides the same structural and functional characteristics as will be described herein. In order to prevent the enclosure 14 from leaking hydraulic or pneumatic fluid, annular or O-ring seals 27 are provided between the end caps 13, 15 and the internal cylinder 17. The first and second passageways 16, 18 extend into the enclosure 14 and communicate with the bore 20. Each of the first and second passageways 16, 18 has a boss 22 connected to and extending from the enclosure 14 for connecting and communicating the passageways 16, 18 to a pressurized air source (not shown). Each boss 22 has a threaded aperture 21 extending therethrough for receiving a conventional air line fitting (not shown). Each threaded aperture 21 is in communication with an aperture 23 provided in the enclosure 14. The apertures 23 extend from the threaded aperture 21 of the boss 22 to the bore 20 in the enclosure 14. The bore 20 in the enclosure 14 is substantially cylindrical and has a closed end and an open end. The closed end has a recessed portion 25 that is smaller than the diameter of the main portion of the cylindrical bore 20. The open end has an aperture 35 that is smaller than the diameter of the bore 20 and extends through the enclosure 14 for receiving the piston rod 26.

To move the workpiece 11 between the retracted and extended position the piston rod 26 is partially disposed within the bore 20 of the enclosure 14. The piston rod 26 is slidably supported by a bushing 32, which is mounted within the bore 20 at the open end of the enclosure 14. A U-cupped seal and a wiper seal 29 are mounted within the inside diameter of the bushing 32 to seal the piston rod 26 from the bushing 32. A U-cupped seal and wiper seal 31 are also mounted within the aperture 35 in the open end of the enclosure 14 to seal the piston rod 26 from the enclosure 14. The illustrated drawings depict the bushing 32 as occupying the entire cross-sectional area of the bore 20 perpendicular to the axis of movement, but it is to be appreciated that the bushing 32 can be of any geometric configuration capable of supporting the movement of the piston rod 26 and stopping the movement of the piston 24 within the bore 20. The piston rod 26 extends along a longitudinal axis 33 of the bore 20, wherein one end of the piston rod 26 extends outside the enclosure 14, and an opposite end of the piston rod 26 remains inside the enclosure 14. The external or outside end of the piston rod 26 is threaded to engage the workpiece 11 or a fixture (not shown) for engaging the workpiece 11.

The internal end of the piston rod 26 threadingly engages a substantially cylindrical fitting 30. The internal end of the piston rod 26 has a smaller diameter than the main body of the piston rod 26 such that the fitting 30 engages the main body of the piston rod 26 when fully threaded onto the piston rod 26. In the retracted position, the fitting 30 and internal end of the piston rod 26 are disposed within the recess 25 of the enclosure 14, but do not engage the back wall of the recess 25. The workpiece 11 engages the enclosure 14 so as to prevent the fitting 30 and internal end of the piston 26 from engaging the back wall of the recess 25.

In order to effectuate the varying actuation forces to the workpiece 11, the piston 24, having a substantially cylindrical shape, is slidably disposed on the cylindrical portion 28 of the piston rod 26 within the enclosure 14. An annular seal 34 is provided on the inner diameter of the piston 24 to seal the piston 24 against the cylindrical portion 28 of the piston rod 26, and another annular seal 36 is provided on the outer diameter of the piston 24 to seal the piston 24 from the interior wall of the enclosure 14. The piston 24 has a surface area substantially perpendicular to the longitudinal axis 33 of the bore 20 that is larger than the surface area of the fitting 30 and the end of the piston rod 26 substantially perpendicular to the longitudinal axis 33 of the bore 20.

In operation, the piston rod 26 and the piston 24 may begin in the retracted position, as shown in FIG. 1. When in the retracted position, the fitting 30 and the internal end of the piston rod 26 are disposed within the recess 25 of the enclosure 14, and the piston 24 abuts the fitting 30. When the power cylinder apparatus 10 is actuated, pressurized air is introduced through the first passageway 16 and behind the piston 24, fitting 30, and internal end of the piston rod 26. The force of the pressurized air from the first passageway 16 pushes the piston 24 along the cylindrical portion 28 of the piston rod 26 until the piston 24 abuts the bushing 32, as shown in FIG. 2. During the movement of the piston 24, air in the bore 20 is allowed to escape through the second passageway 18. Upon the further supply of pressurized air through the first passageway 16, the force of the air on the fitting 30 and the internal end of the piston rod 26 forces the piston rod 26 to move toward the extended position. The piston rod 26 reaches the extended position when the fitting 30 abuts the piston 24, as shown in FIG. 3.

When it is desired to return the piston rod 26 and the workpiece 11 to the retracted position, pressurized air is introduced through the second passageway 18 and behind the piston 24. The pressurized air from the second passageway 18 forces the piston 24 to move toward the retracted position and engage the fitting 30 on the piston rod 26. As a result of the relative positions of the fitting 30 and the piston 24, movement of the piston 24 toward the retracted position forces the fitting 30 and the piston rod 26 toward the retracted position together with the travel of the piston 24 such that the piston rod 26 and the piston 24 return to the retracted position simultaneously.

Different actuation forces are imparted on the piston rod 26 and the workpiece 11 as they move toward the retracted position as opposed to the extended position. The different actuation forces are a result of the different surface areas of the fitting 30 and the internal end of the piston rod 26 as compared to the surface area of the piston 24 substantially perpendicular to the longitudinal axis 33 of the bore 20. A well-known principle in fluid mechanics provides the following:

$$F=PS$$

where F is the force exerted by the pressurized air upon an object, P is the pressure of the pressurized air, and S is the surface area of the object substantially perpendicular to the force. As can be seen from the formula F=PS, the force exerted by the pressurized air has a direct relationship to the surface area of the object, given a constant pressure, such that the larger the surface area of an object, the more force is exerted by the pressurized air upon the object. Conversely, the smaller the surface area of an object, the less force is exerted by the pressurized air upon the object.

Under the same pressure, the principle of F=PS provides for a smaller actuation force imparted on the workpiece 11 when the piston rod 26 moves toward the extended position as compared to the larger force imparted on the workpiece 11 when the piston rod 26 moves toward the retracted position. The smaller combined surface area of the fitting 30 and the internal end of the piston rod 26, as compared to the surface area of the piston 24, requires that a smaller force will be imparted upon the workpiece 11 when moving from the retracted position to the extended position. Since the piston 24 moves from the retracted position to the extended position alone, that is, prior to the piston rod 26 moving, the surface area of the piston 24 is not a factor when determining the actuation force of the piston rod 26 when moving toward the extended position. Conversely, a larger force will be imparted upon the workpiece 11 when moving from the extended position to the retracted position as a result of the larger surface area of the piston 24, as compared to the combined surface area of the fitting 30 and the internal end of the piston rod 26. Since only the piston 24 is exposed to the pressurized air when moving toward the retracted position, only the surface area of the piston 24 is a factor in determining the actuation force applied to the workpiece 11 when moving toward the retracted position.

As seen from the above-noted discussion, the actuation forces applied to the workpiece 11 may vary with the surface areas of the piston 24, the fitting 30, and the internal end of the piston rod 26. In addition, the actuation forces may be made equal in both directions by equating the surface areas of the piston 26 as opposed to the combined surface area 40 of the fitting 30 and the internal end of the piston rod 26.

While the invention has been described in connection with what is presently considered to be the most practical and preferred embodiment, it is to be understood that the invention is not to be limited to those disclosed embodiments, but, to the contrary, it is intended to cover various modifications and equivalent arrangements included within the spirit and scope of the appended claims which scope is intended to be accorded the broadest interpretation so as to encompass all such modifications and equivalent structures as is permitted under the law.

What is claimed is:

1. An apparatus for varying actuation forces to a workpiece, comprising:

an enclosure;

a piston rod connectable to said workpiece and slidably disposed within said enclosure for movement between a retracted position, wherein said piston rod is retracted within said enclosure, and an extended position, wherein said piston rod extends outwardly from said enclosure;

a piston slidably disposed on said piston rod for movement from said retracted position to said extended position while said piston rod remains idle in said retracted position; and means, through a supply of a constant fluid pressure, for supplying varying actuation forces to said workpiece.

2. The apparatus stated in claim 1, wherein said supplying means further comprises:

said piston rod and said piston having different surface areas substantially perpendicular to the direction of said movement when moving between said retracted position and said extended position to provide different actuation forces to said workpiece.

3. The apparatus stated in claim 1, wherein said supplying means further comprises:

said piston rod and said piston having substantially equal surface areas substantially perpendicular to the direction of said movement when moving between said retracted position and said extended position to provide substantially similar actuation forces.

4. The apparatus stated in claim 1, further comprising:

a bushing disposed within said enclosure for slidably supporting said piston rod and positively stopping said piston in said extended position.

5. The apparatus stated in claim 1, further comprising:

said varying actuation forces being less when said piston rod moves toward said extended position than when said piston rod moves toward said retracted position.

6. An apparatus for varying actuation forces to a workpiece, comprising:

an enclosure having an enclosed bore;

a first and second passageway in said enclosure and communicable with a pressurized fluid source for communicating pressurized fluid with said bore;

a piston rod slidably disposed within said enclosure for movement along a longitudinal axis of said bore between a retracted position, wherein said piston rod is retracted within said enclosure, and an extended position, wherein said piston rod extends outwardly from said enclosure;

a piston slidably disposed on said piston rod for movement between said retracted position and said extended position wherein said piston slides on and relative to said piston rod when moving from said retracted position to said extended position and moves with said piston rod when moving from said extended position to said retracted position; and a fitting connected to an internal end of said piston rod within said enclosure wherein said piston slides on said piston rod from said retracted position to said extended position before said fitting and said piston rod move from said retracted position to said extended position.

7. The apparatus stated in claim 6, further comprising:

said piston cooperatively engaging said fitting in said extended position such that said piston engages said fitting and moves said piston rod when moving from said extended position to said retracted position.

8. The apparatus stated in claim 6, further comprising:

said fitting and said internal end of said piston rod having a combined surface area substantially perpendicular to said longitudinal axis of said bore that is less than a surface area of said piston substantially perpendicular to said longitudinal axis of said bore.

9. The apparatus stated in claim 6, further comprising:

said fitting and said internal end of said piston rod having a combined surface area substantially perpendicular to said longitudinal axis of said bore that is substantially equal to a surface area of said piston substantially perpendicular to said longitudinal axis of said bore.

10. The apparatus stated in claim 6, further comprising:

a bushing disposed within said bore for slidably supporting said piston rod and positively stopping said piston in said extended position.

11. An apparatus for varying actuation forces to a workpiece, comprising:

an enclosure having an enclosed bore;

a first and second passageway in said enclosure and communicable with a pressurized air source for communicating pressurized air with said bore;

a piston rod slidably disposed within said enclosure for movement along a longitudinal axis of said bore between a retracted position, wherein said piston rod is retracted within said enclosure, and an extended position, wherein said piston rod extends outwardly from said enclosure;

a piston slidably disposed on said piston rod and enclosed within said enclosure for movement between said retracted position and said extended position wherein said piston slides on and relative to said piston rod when moving from said retracted position to said extended position and moves with said piston rod when moving from said extended position to said retracted position;

a fitting connected to an internal end of said piston rod within said enclosure wherein said piston slides on said piston rod from said retracted position to said extended position before said fitting and said piston rod move from said retracted position to said extended position;

said piston cooperatively engaging said fitting in said extended position to move said piston rod from said extended position to said retracted position; and a bushing disposed within said bore for slidably supporting said piston rod and positively stopping said piston in said extended position.

12. The apparatus stated in claim 11, further comprising:

said fitting and said internal end of said piston rod having a combined surface area substantially perpendicular to said longitudinal axis of said bore that is less than a surface area of said piston substantially perpendicular to said longitudinal axis of said bore to provide a greater actuation force when moving toward said retracted position than said extended position.

13. The apparatus stated in claim 11, further comprising:

said fitting and said internal end of said piston rod having a combined surface area substantially perpendicular to said longitudinal axis of said bore that is substantially equal to a surface area of said piston substantially perpendicular to said longitudinal axis of said bore to provide substantially equal actuation forces when moving toward said retracted position and said extended position.

14. The apparatus stated in claim 11, further comprising:

said fitting abutting said piston in said retracted position.

15. The apparatus stated in claim 11, further comprising:

said bore having a closed end with a recess formed in the enclosure; and said fitting and said internal end of said piston rod disposed within said recess when in said retracted position.

* * * * *